United States Patent [19]

Manchester, Jr.

[11] 3,964,250

[45] June 22, 1976

[54] WRISTWATCH CASE

[75] Inventor: Isaac F. Manchester, Jr., South Dartmouth, Mass.

[73] Assignee: FAS/CON Systems, Inc., South Dartmouth, Mass.

[22] Filed: Mar. 24, 1975

[21] Appl. No.: 561,268

[52] U.S. Cl. ..... 58/88 R
[51] Int. Cl.[2] ..... G04B 37/00
[58] Field of Search ..... 58/88 R, 98; 224/4 E

[56] References Cited

UNITED STATES PATENTS 2,990,988 7/1961 Ziegenbein ..... 224/4 E

*Primary Examiner*—L. T. Hix
*Assistant Examiner*—Vit W. Miska
*Attorney, Agent, or Firm*—Salter & Michaelson

[57] ABSTRACT

A watchcase and band that embodies a case wherein novel means is provided for the attachment, replacement or changes of watch bands in a rapid and efficient manner.

13 Claims, 6 Drawing Figures

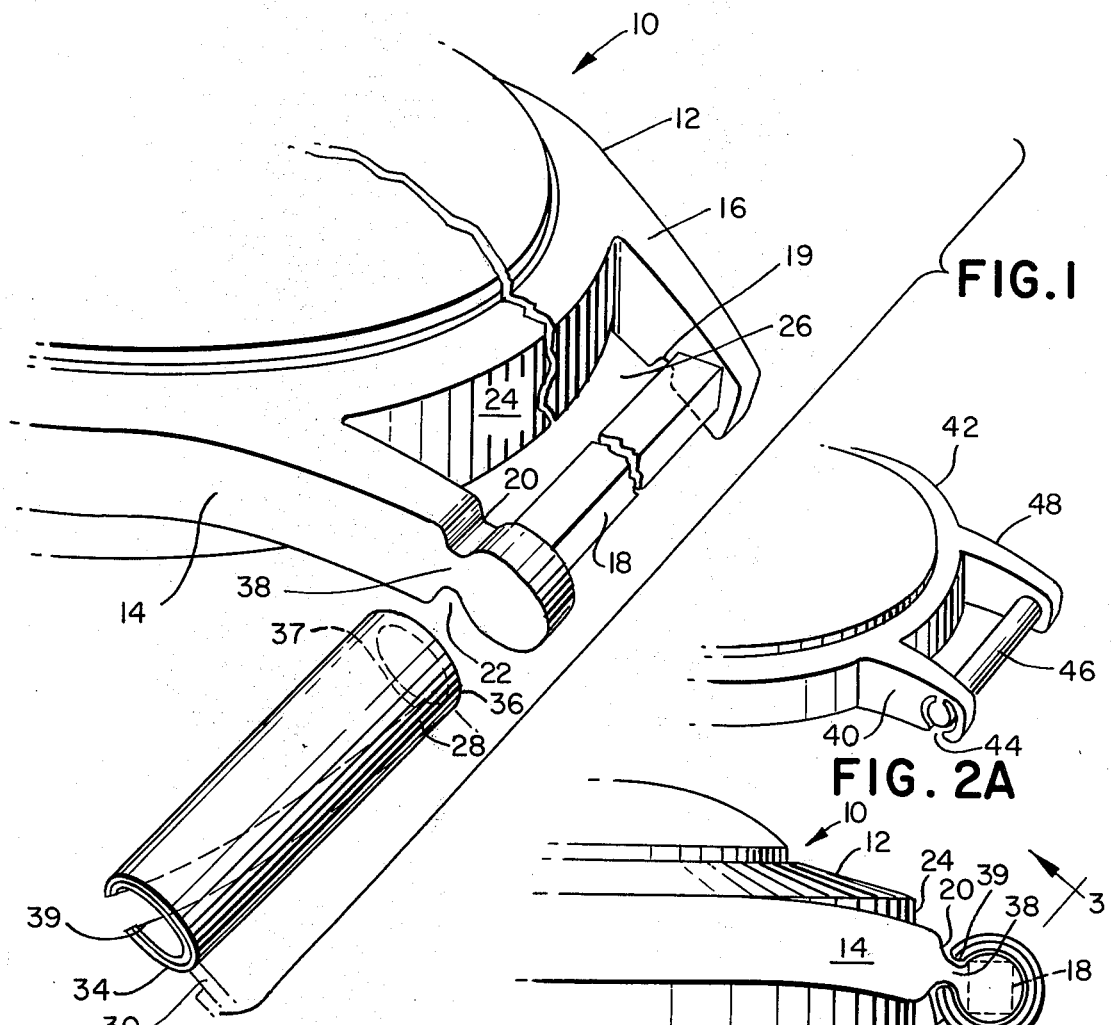
FIG. 1
FIG. 2A
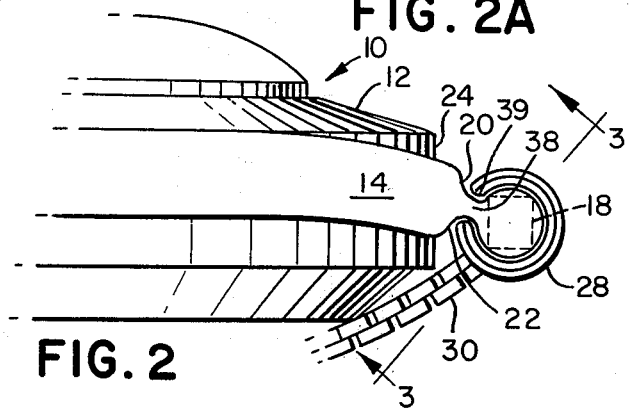
FIG. 2
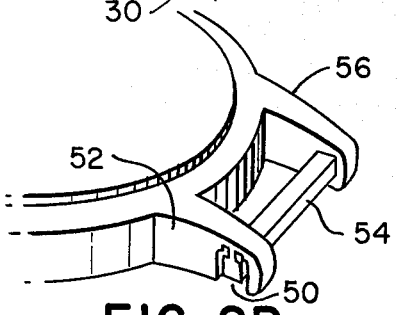
FIG. 2B
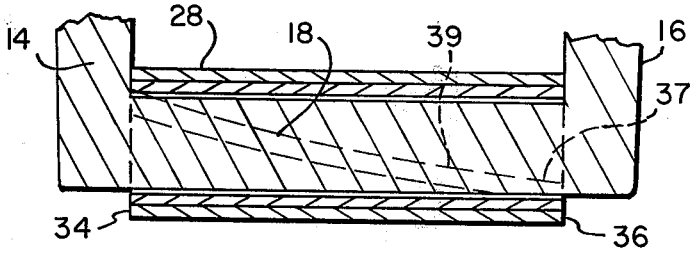
FIG. 3
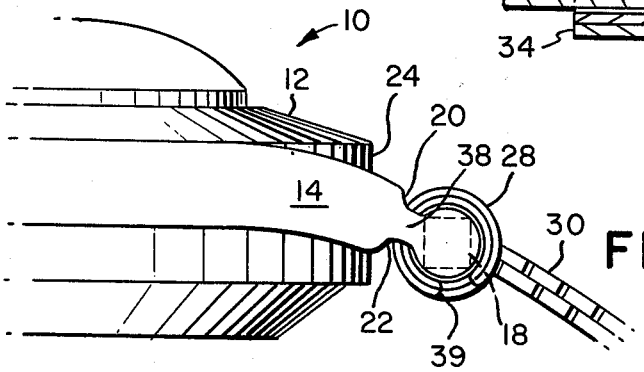
FIG. 4

WRISTWATCH CASE

BACKGROUND OF THE INVENTION

The invention resides in the field of watchcases, and in particular wrist watchcases and watchbands for attachment thereto.

DESCRIPTION OF THE PRIOR ART

Prior to the present invention, the usual wrist watch readily available and on the market has the watch mechanism enclosed in a case provided with extended lugs and a spring pin extended between and removably secured to the lugs. The watchstrap, whether it be made of a metal such as an expansion band, leather or of another material is secured to the watch by means of the spring pin. The spring pin contains movable parts and requires a particular bearing for the pin on each end of the watchstrap through which the pin is extended. The necessary provision of the spring pin substantially increases the expense involved in manufacturing the watchcase. It is understood that the expense involved in manufacturing and assembling the pins comprises a major portion of the expense in the manufacture of watchcases. The manufacturer is, of course, also burdened with the expense of assembling the pins themselves since additional labor is required in the attachment of the band to the case.

In addition, it is difficult and bothersome for the average person to change watchbands himself due to the difficulty in removing and replacing the spring pin. In most cases a jeweler's tool is necessary in order to change bands whenever it is necessary or it is desired to do so.

It is also a fact that the spring pins become bent or otherwise damaged and must be frequently replaced even though the watchstrap is still usable.

The disadvantages of the prior art structures are substantially eliminated by the present novel and improved watchcase and band structure. The present invention embodies a case having a novel and integral structure particularly arranged for cooperation with a simplified coupling integral with each end of a watchstrap.

Perhaps the most important advantage in the present invention resides in the fact that it enables the watchcase to be produced by either a casting or stamping operation in an economical manner. The necessity for second and third manufacturing operations such as drilling holes for the spring pins is eliminated.

Thus it is contemplated that the present invention enables a substantially one-piece watch case to be produced in a single manufacturing operation with expensive and troublesome moving parts eliminated. This provides for efficiency in use and reduced manufacturing expense.

SUMMARY OF THE INVENTION

The present invention contemplates a novel and improved wrist watchcase and band which embody novel and improved structure whereby the case is stamped or cast in one operation and wherein the necessity of making additional provisions for the attachment of the band to the case such as the spring pins heretofore commonly used in the trade for attaching the watchband to the case are eliminated.

It will be understood that in accordance with the present invention the clasp or coupling provided on the ends of the watchstrap or band may be greatly simplified and be in the form of a split or longitudinally slotted tube arranged to mate with and slip into operative engagement with the present novel watchcase structure whereby the band is readily secured thereto.

Accordingly, the present invention has for a principal object to provide a novel and improved watchcase structure and a simplified band coupling enabling the band to be easily and efficiently attached to the watchcase.

Another object of the invention is to provide a novel and improved watchcase structure embodying novel features which enable the case to be economically manufactured and the expense of the assembly of the case and band substantially reduced.

Still another object is to provide a novel and improved watchcase embodying novel structure for attaching a band thereto which enables the case to be manufactured with a minimum of casting or stamping operations whereby costs are reduced.

Another object of the invention is to provide a watchcase and watchband having a novel coupling means wherein the structure embodies no moving parts other than the band itself thus expense of repair or loss of the watch is minimized.

A still further object is to provide a watch structure embodying novel means whereby a simplified band structure may be provided enabling the consumer to easily change watchbands and thereby use bands of different designs or colors for different occasions.

With these general objects in view and such others as may hereinafter appear the present invention resides in the present novel watchcase structure and in the watchband and coupling structure hereinafter described and particularly defined in the claims at the end of this specification.

BRIEF DESCRIPTION OF THE DRAWINGS

In the drawings illustrating the preferred embodiment of the invention:

FIG. 1 is a fragmentary exploded perspective view of the watchcase, band and coupling prior to assembly;

FIG. 2 is a side elevation of the watchcase of FIG. 1 with the watchband initially engaged;

FIG. 2A is a fragmentary perspective view of a modified form of watchcase structure;

FIG. 2B is a fragmentary view of still another modified form of the invention;

FIG. 3 is a cross-section taken on the line 3—3 of FIG. 2; and

FIG. 4 is a side view of the watchcase with the watchband fully engaged.

Referring now to the drawings 10 illustrates a wrist watchcase which may be of any conventional or unconventional design for encasing the working elements of watch. As shown, the body 12 of the case is provided with integral flanges or lugs 14, 16 herein extending laterally from the side of the case, only one side or pair of flanges herein is illustrated. The flanges 14, 16 are connected by a rectangular bar 18 at their outer ends. One of the flanges, 14, is provided with notches 20–22 in its upper and lower and flange 16 with a notch 19 in itself underside, surfaces lower and flange 16 with a notch 19 in itself underside, surfaces adjacent the bar 18. As shown, the flanges and bar together with the outer wall 24 of the watchcase body 12 define a somewhat rectangular slot 26 adapted to receive the coupling 28 secured to or integral with the end of the watchband 30, partially shown in FIG. 1.

FIG. 1 also shows the end portion of a metal expansion type of watchband 30 having a coupling 28 in the form of an elongated split tube secured thereto. The split ends 34, 36 of the tube 28 are spaced apart a distance slightly greater than the thickness of notched portion 38 of flange 14 and define between them on angular, elongated slot 39.

As best shown in FIGS. 1 and 2 the ends 34, 36 of coupling or tube 28 defining elongated slot 39 are each cut at an angle such that the inner dimension of the slot 39 is less than at the entrance portion of the slot. Slot 39 in tube 28 extends generally angularly across the elongated face of the tube 28 downwardly from left to right as shown clearly in FIG. 1.

In accordance with the present invention,

FIGS. 1, 2, and 4 illustrate the sequence of steps in coupling the band to the watchcase.

Referring first to FIG. 1, the band 30 is held so that slot 39 is aligned with the notched portion 38 of flange 14. This is accomplished by moving the band against the back or underside of the watchcase as shown in FIG. 2. It will be seen that when held in this position the end 37 of slot 39 in tube 28 is aligned with notched portions 20, 22 and the tube and attached band urged through flange 14 onto square bar 18.

As shown in FIGS. 2 and 4 as the tube 28 and band 30 assembly is urged onto the square bar 18 the angular slot 39 causes the tube 28 and band to rotate approximately 90° relative to the horizontal axis of the watchcase when the tube 28 is seated fully on the bar 18 with the end 37 of the tube against lug or flange 16 and the tube seated in slot 26 between the case and bar. It will be seen that the angular disposition of slot 39 not only prevents the tube from catching on the square corners of the bar, but also creates a locking effect or stop which assists in preventing displacement of the watchband from the case when the watch is removed from the wearer's wrist. The angular slot 39 also causes the band to move to a normal position relative to the watchcase when the watch is worn with the tube in a fully locked and engaged position. Also angular slot 39 is positioned completely on the underside of the band where nothing can get caught in the slot such as clothing or any object the wearer may strike or accidentally come in contact with. The slot is also invisible to any observer hence the angular slot will not detract from the beauty or appearance of the band design.

It will be understood that the inside diameter of the tube or coupling 28 is just slightly greater than that of the bar 18 so that when in full engagement with the bar the tube and band may freely rotate relative to each other.

As hereto described initially the tube or coupling 28 attached to or integral with band 30 slides over notched flange 14, however, it is understood that it can be slipped over notched flange 16 and then over bar 18 if desired.

In a modified form of the invention illustrated in FIG. 2A flange 40 extends laterally from the watchcase 42 and is provided with a generally rounded u-shaped entry slot 44. Slot 44 extends around the end of round bar 46 extend between flange 40 and 48. The band coupling 28 is slid into slot 44 and over bar 46 in the same manner as heretofore described in connection with the assembly of the case and band of FIG. 1.

FIG. 2B shows another modified form of the invention wherein a generally square u-shaped slot 50 is provided in flange 52 and surrounds a square bar 54 extended between flanges 52, 56 as shown.

The band coupling 28 is inserted into and through slot 50 and onto square 54 in the manner heretofore described in connection with the other forms of the invention. While the flange 14 of FIG. 1 has been illustrated and described as embodying upper and lower notches it will be understood that one notch either top or bottom may be provided. The band is then engaged and attached to the watchcase in the described manner.

While for the purpose of illustration and not by way of limitation the structures of only one side of the watchcase and one end of the band have been illustrated and described it will be understood that the watchcase is provided with exactly the same structure on its other side as is the other end of the band.

It is within the contemplation of the present invention that in addition to the use of metal watchbands with the present watchcase and band structure the use of existing leather or other bands may be used. In order to accomplish this an adapter may be provided embodying the split tube coupling 28 which is secured to the band. The band is secured to the adapter either by the use of a spring pin in the usual manner or by means of sewing, stitching or adhesive.

From the foregoing description it will be apparent that the present invention provides novel and improved structure whereby watchbands may be readily attached to the watchcase. It is contemplated that the present invention enables the owner of the watch embodying the invention to readily change bands whenever he desires to do so. This has a great advantage over the present watchcase and band structure wherein substantially all of the watches on the market are provided with a spring pin assembly for attaching the watchband which makes changing of the band difficult. It will also be apparent that the present invention substantially reduces the number of operations now required in watchcase production by enabling the watchcase to be stamped or cast in one operation. The invention also enables the coupling on the ends of the watchband to be simplified. It is also to be understood that the expense incurred by the watch manufacturer in providing spring pins, in assembling the watchband and spring pins and then attaching the watchband to the watch by means of the spring pins is greatly reduced.

While the present invention has been illustrated and described as embodying watches utilizing metal watchbands, it is contemplated that watchbands of any suitable material may be utilized in accordance with the present invention.

Having thus described the invention, what is claimed is:

1. A wristwatch case and a band for detachably maintaining the watch case including the operating parts of the watch on the wrist of the wearer, said wristwatch case comprising a body portion for the operating parts of the watch and pairs of spaced lugs integral with and extending laterally from the watch case body portion, a bar extending between and integral with the lugs and spaced outwardly from the body portion, one of the lugs having a portion of reduced thickness adjacent the bar, and a watch band having means secured at each end thereof for detachably securing the band upon the bars extended between each pair of lugs, said means comprising a split tube, said tube having a generally diagonally extended slot, the tube adapted to be slipped over the reduced diameter portion of one lug and onto the bar with the lug passing through the slot such that the tube and band are urged outwardly and upwardly as the tube moves onto the bar and between the lugs to thereby operatively secure the band to the watch case.

2. A wristwatch case and band as defined in claim 1, wherein the split tube is cylindrical and the bar is square.

3. A wristwatch case and band as defined in claim 1, wherein the one lug is provided with notches in its upper and lower surfaces forming said reduced diameter portion.

4. A wristwatch case and band as defined in claim 1, wherein one lug is provided with notches in the upper and lower surfaces and the other lug of the pair is provided with a notch in its lower surface.

5. A wristwatch case and band as defined in claim 1, wherein the bar is round.

6. A wristwatch case for the operating parts of the time-piece and a band cooperating with the case, said case having a pair of laterally extended spaced lugs on opposed sides thereof, and a longitudinal bar integral with and extended between the pairs of lugs, said bar, lugs and casing defining a space, said band comprising a strap, and integral means at the free ends of the band arranged to cooperate with the longitudinal bar for detachably securing the band to the watch case, said integral means comprising a cylindrical member provided with a generally helical slot in one wall thereof, said slot extending upwardly from one end of the cylindrical member to the other end thereof, means on at least one of said lugs cooperating with said slot to enable the cylindrical member to be urged onto said bar, said cylindrical member and integral band tuning upwardly while being moved onto the bar and between said lugs, the inside surfaces of said lugs providing shoulders for maintaining the cylindrical member in operative locked position while rotatable on the bar to prevent lateral displacement of the band relative to the watch case when the band is engaged on the bar.

7. A wristwatch case for the operating parts of the time-piece and a band cooperating with the case, said case having a pair of laterally extended spaced lugs on opposed sides thereof, and a longitudinal bar integral with and extended betwen the pairs of lugs, said bar, lugs and casing defining a space, said band comprising a strap, and integral means at the free ends of the band arranged to cooperate with the longitudinal bar for detachably securing the band to the watch case, said integral means comprising a cylindrical member provided with a slot in one wall thereof, said slot extending upwardly from one end of the cylindrical member to the other end thereof, means on at least one of said lugs cooperating with said slot to enable the cylindrical member to be urged onto said bar, said cylindrical member and integral band turning upwardly while being moved onto the bar and between said lugs, said means on at least one of said lugs comprising a generally U-shaped slot in the underside of the said lug.

8. A wrist watch case and band as defined in claim 7, wherein said longitudinal bar is square.

9. A wristwatch case for the operating parts of the time-piece and a band cooperating with the case, said case having a pair of laterally extended spaced lugs on opposed sides thereof, and a longitudinal bar integral with and extended between the pairs of lugs, said bar, lugs and casing defining a space, said band comprising a strap, and integral means at the free ends of the band arranged to cooperate with the longitudinal bar for detachably securing the band to the watch case, said integral means comprising a cylindrical member provided with a slot in one wall thereof, said slot extending upwardly from one end of the cylindrical member to the other end thereof, means on at least one of said lugs cooperating with said slot to enable the cylindrical member to be urged onto said bar, said cylindrical member and integral band turning upwardly while being moved onto the bar and between said lugs, said means cooperating with the cylindrical member comprising a cylindrical slot in at least one lug to enable the cylindrical member to pass through the lug and onto the longitudinal bars and into the space between the lugs, watch case and bar.

10. A wristwatch case and band as defined in claim 9, wherein the longitudinal bar is cylindrical.

11. A connector assembly for the attachment of a wristband to a wristwatch case, wherein said case includes a pair of laterally extending lugs joined to said case in spaced relation, comprising a bar extending between and secured to said lugs and being spaced from said case, said wristband including an elongated strap on at least one free end thereof a coupling member is secured, said coupling member having a generally helically extending slot formed therein that extends longitudinally of the coupling member for the length thereof, at least one of said lugs being formed so as to enable said coupling member to be accommodated thereon, wherein said coupling member is rotated onto said bar as said helical slot passes over said one lug, thereby securing said coupling member between said lugs and removably attaching the wristband to said case.

12. A connector assembly as defined in claim 11, said coupling member being tubular in construction.

13. A connector assembly as defined in claim 12, said one lug having a portion of reduced thickness for receiving the slot of the tubular coupling member as said coupling member is rotated onto said bar.

* * * * *